US005662394A

United States Patent [19]

Choi

[11] Patent Number: 5,662,394

[45] Date of Patent: Sep. 2, 1997

[54] LOW-TEMPERATURE SHOWCASE

[75] Inventor: Nam-Chul Choi, Incheon, Rep. of Korea

[73] Assignee: Daewoo Electronics Co., Ltd., Seoul, Rep. of Korea

[21] Appl. No.: 703,495

[22] Filed: Aug. 27, 1996

[30] Foreign Application Priority Data

Aug. 28, 1995 [KR] Rep. of Korea ..... 95-26865

[51] Int. Cl.[6] ..... A47B 81/00

[52] U.S. Cl. ..... 312/116; 62/249

[58] Field of Search ..... 312/114, 116, 312/236, 249.2, 125; 62/249, 255

[56] References Cited

U.S. PATENT DOCUMENTS

| | | | |
|---|---|---|---|
| 2,030,780 | 2/1936 | Bicknell | 312/125 |
| 3,171,473 | 3/1965 | Lawler | 62/255 |
| 4,258,966 | 3/1981 | Grubb | 312/125 |
| 4,953,362 | 9/1990 | Shoji et al. | 312/116 |
| 5,277,486 | 1/1994 | Bustos | 312/125 |
| 5,549,373 | 8/1996 | Bustos | 312/125 |

*Primary Examiner*—Peter R. Brown
*Assistant Examiner*—Gerald A. Anderson
*Attorney, Agent, or Firm*—Pennie & Edmonds LLP

[57] ABSTRACT

A low-temperature showcase comprises an upper case including at least two doors, an intermediate plate provided with an air inlet and an air outlet, a bottom plate having an opening, an air duct defined by the intermediate plate and the bottom plate, a lower case including a cavity in which an evaporator and a fan are installed, and a thrust ball bearing. The evaporator and the fan generate a cold air flow which is circulated along the air duct and into an interior of the upper case. The thrust ball bearing includes a ring-shaped upper member provided With an annular groove, a ring-shaped lower member provided with a plurality of recesses formed along an arbitrary circle corresponding to the annular groove and a plurality of balls fitted into both the recesses and the groove. The upper and the lower members are fixed to an under surface of the bottom plate of the upper case around the opening and a top surface of the lower case around the cavity, respectively, the balls for rotatably bearing the upper member, thereby allowing the upper member and hence the upper case to be rotatable.

4 Claims, 5 Drawing Sheets

LOW-TEMPERATURE SHOWCASE

FIELD OF THE INVENTION

The present invention relates to a low-temperature showcase; and, more particularly, to a low-temperature showcase having a rotatable upper case provided with a front and a rear doors, the rear door for facilitating the removal of foods stored in a deeper side of the showcase.

DESCRIPTION OF THE PRIOR ART in FIG. 1, there is shown a conventional refrigerator showcase having an upper and a lower cases 3, 7, a transparent door 2 and a plurality of shelves 4 on which foods are placed. A cooling device (not shown) is disposed in the lower case 7, generating a cold air flow which is circulated along a rear wall and into an interior of the upper case 3 of the showcase. The cold air is dispersed into the interior of the upper case 3 through an air outlet 5 disposed at an upper portion of the upper case 3 and, then, is sucked into the lower case 7 through an air inlet 6 disposed at a lower portion of the upper case 3.

However, in such a conventional showcase, it is difficult to remove the foods stored on the shelf deep inside the upper part when the shelf is fully filled with the foods.

SUMMARY OF THE INVENTION

It is, therefore, a primary object of the invention to provide a low-temperature showcase having a rotatable upper case provided with a front and a rear doors, the rear door for facilitating the removal of foods stored deep inside the showcase.

In accordance With one aspect of the present invention, there is provided a low-temperature showcase comprising: an upper case including at least two doors, an intermediate plate provided with a plurality of air passages formed along edges thereof, a bottom plate having an opening and an air duct defined by the intermediate plate and the bottom plate; a lower case including a cavity in which an evaporator and a fan are installed, the evaporator and the fan generating a cold air flow which is circulated along the air duct and into an interior of the upper case; and means for rotatably supporting the upper case, the supporting means being interposed between the upper and the lower cases.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE PREFERRED EMBODIMENTS

Figure 1:
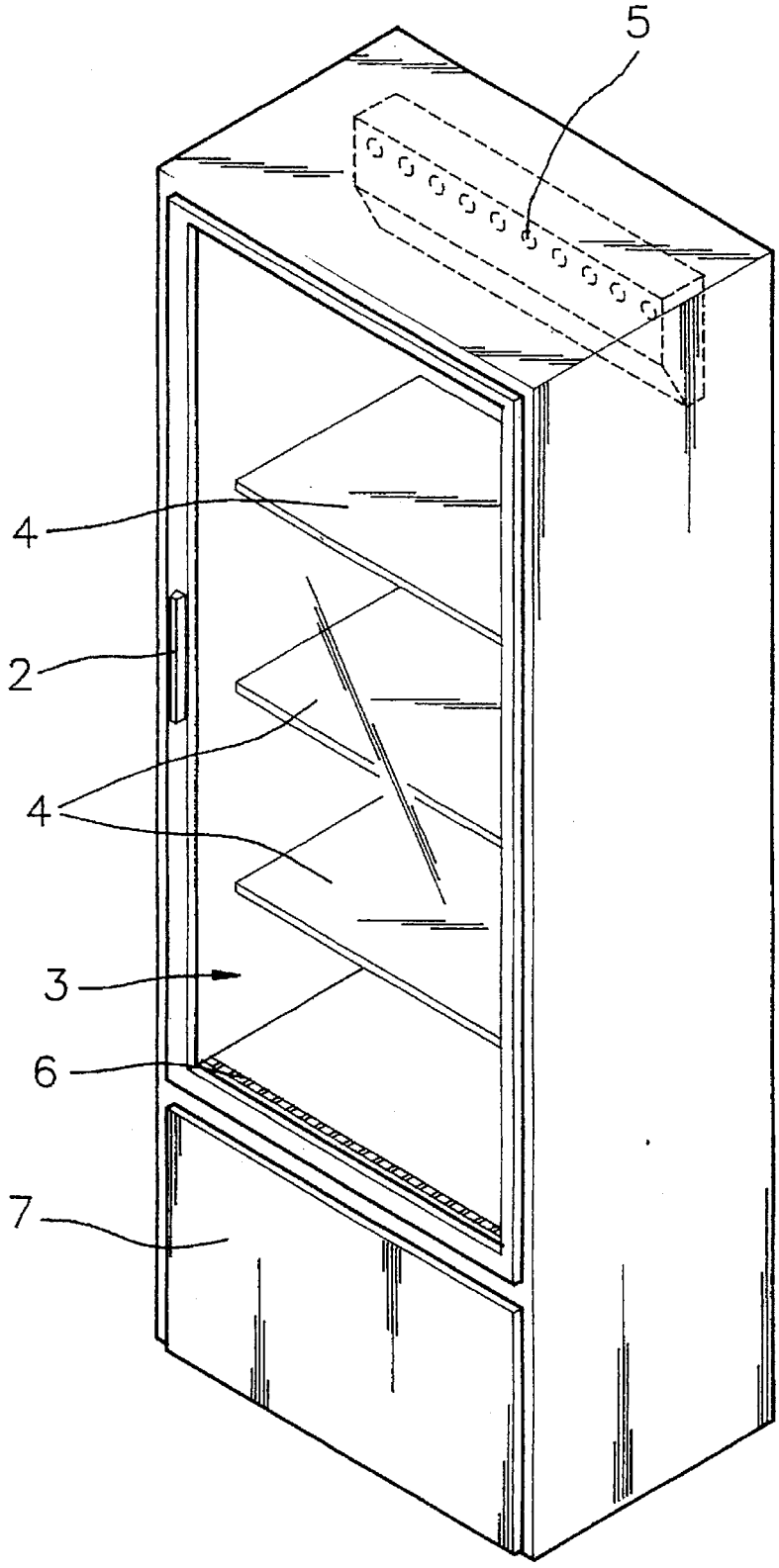
FIG. 1 (PRIOR ART)
FIG. 1 represents a schematic perspective view of a conventional low-temperature showcase.
Figure 2:
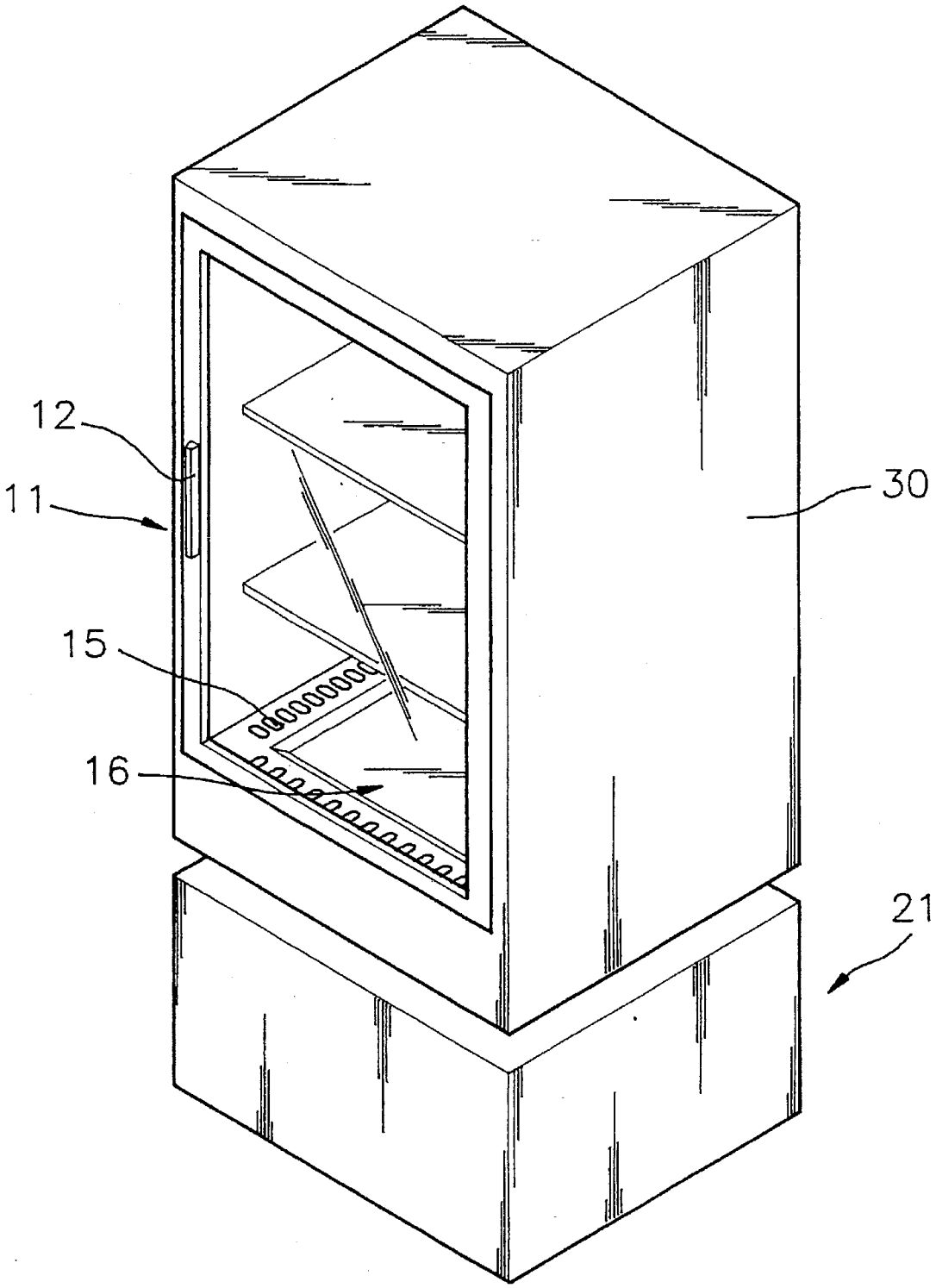
FIG. 2 depicts a schematic perspective view of a low-temperature showcase in accordance with a preferred embodiment of the prevention.
Figure 3:
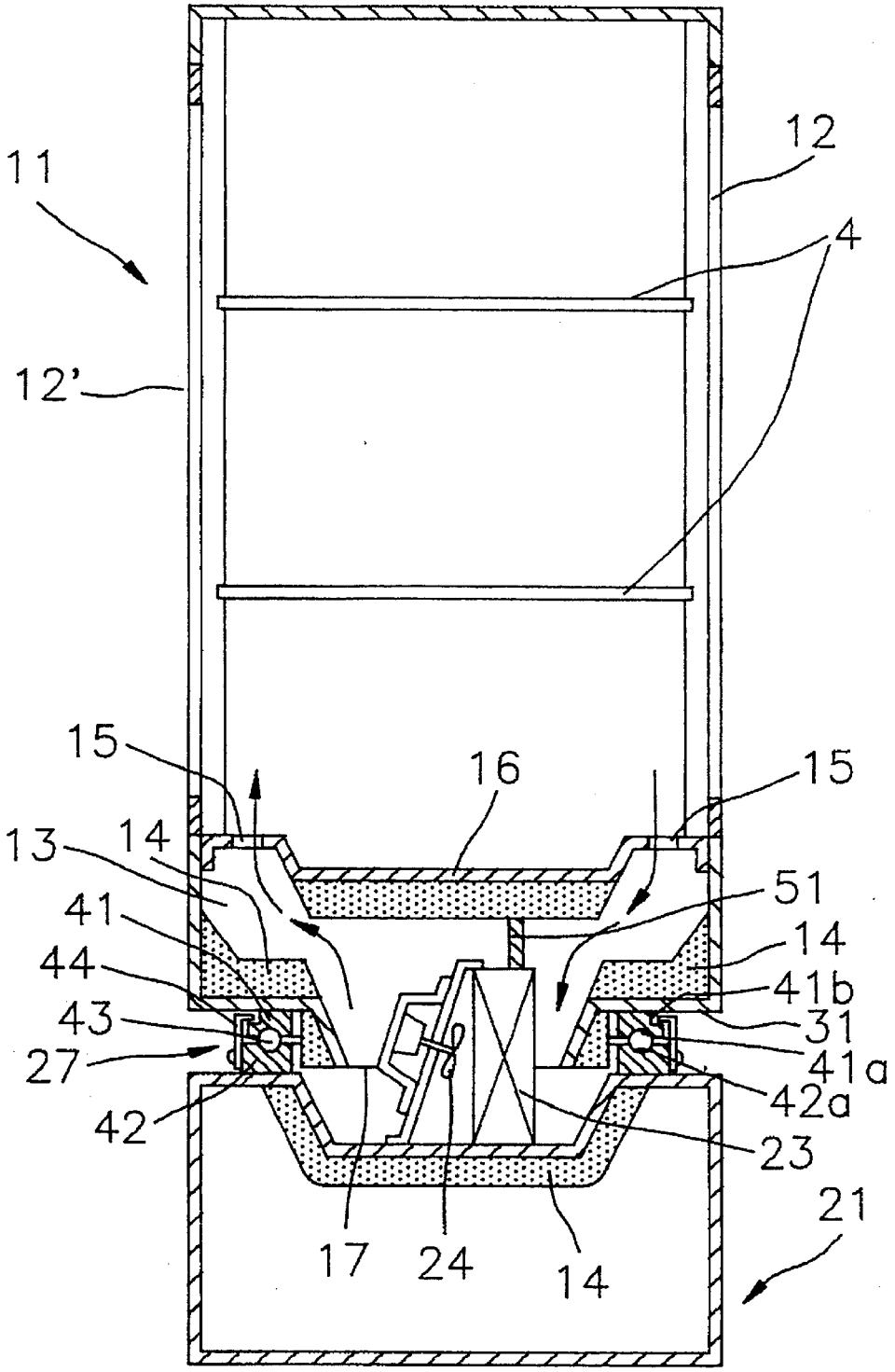
FIG. 3 shows a cross-sectional side view of the low-temperature showcase in FIG. 2.
Figure 4:
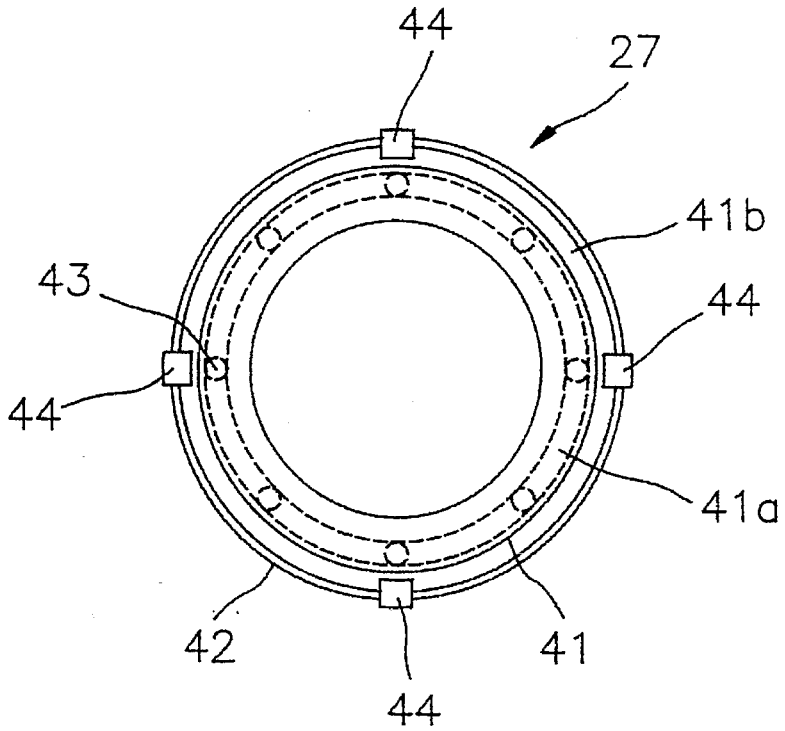
FIG. 4 presents a top view of the thrust ball bearing in FIG.3.
Figure 5:
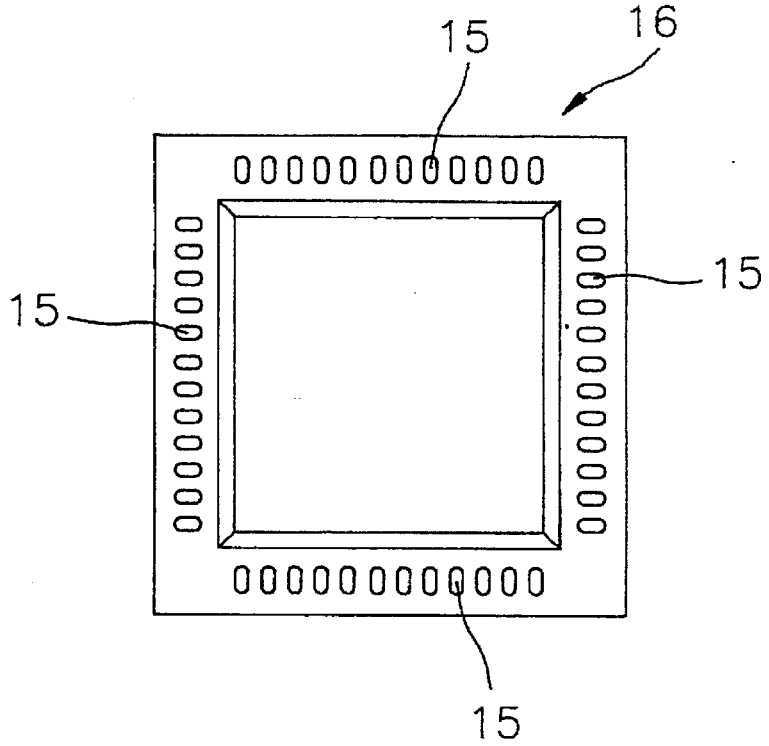
FIG. 5 illustrates a top view of the intermediate plate in FIG. 3.

There are shown in FIGS. 2 to 5 various views of a low-temperature showcase in accordance with a preferred embodiment of the present invention.

The inventive low-temperature showcase comprises an upper case 11, a lower case 21, a thrust ball bearing 27 and a cooling device including an evaporator 23, a fan 24, a compressor (not Shown) and a condensor (not shown).

The upper case 11 includes a transparent front door 12 and a transparent rear door 12', side walls 30, an intermediate plate 16 provided with a plurality of air passages 15 formed in the vicinity of and along the edges thereof, a bottom plate 31 having an opening 17 and an air duct 13 defined by the intermediate plate 16 and the bottom plate 31.

Installed in the upper case 11 are a plurality of shelves 4 on which foods are placed.

The lower case 21 is provided with a cavity 28 in which the evaporator 23 and the fan 24 are installed. The other elements of the cooling device are installed in the lower case 21. The evaporator 23 and the fan 24 generates a cold air flow which is circulated in a direction indicated by arrows in FIG. 2 along the air duct 13 and into the interior of the upper case 11 through the air passages 15. In other words, the cold air is effused into the interior of the upper case 11 through the air passages 15 located near the fan 24 and is, then, sucked into the air duct 13 through the air passages 15 located near the evaporator 23. It is preferable that a partition 51 be installed around the evaporator 23 to prevent the air from passing by the evaporator 23.

The thrust ball bearing 27 includes a ring-shaped upper member 41 provided with an annular groove **41*a* and a cut-out portion 41*b* provided along a circumferential surface thereof, a ring-shaped lower member 42 provided a plurality of recesses 42*a* formed on top thereof at regular intervals along an arbitrary circle corresponding to the annular groove 41*a*, a plurality of balls 43 fitted into both the recesses 42*a* and the groove 41*a* and a plurality of L-shaped restrainers 44. The upper member 41 and the lower member 42 are fixed to an under surface of the bottom plate 31 of the Upper case 11 around the opening 17 and a top surface of the lower case 21 around the cavity 28, respectively, the balls 43 rotatably bearing the upper member 41, thereby allowing the upper member 41 and hence the upper case 11 to be rotatable. In addition, the restrainers 44 are secured to the circumferential surface of the lower member 42 at their one ends by e.g., screws, and the other ends thereof are fitted into the cut-out portion 41*b*, thereby preventing the upper member 41 from deviating from the lower member 42**.

Attached under the intermediate plate 16 is a thermal insulation material 14 for preventing a heat exchange between the air duct 13 and the interior of the upper case 11. The thermal insulation material 14 is also disposed on the bottom plate 31 and around the cavity 28.

Figure 6:
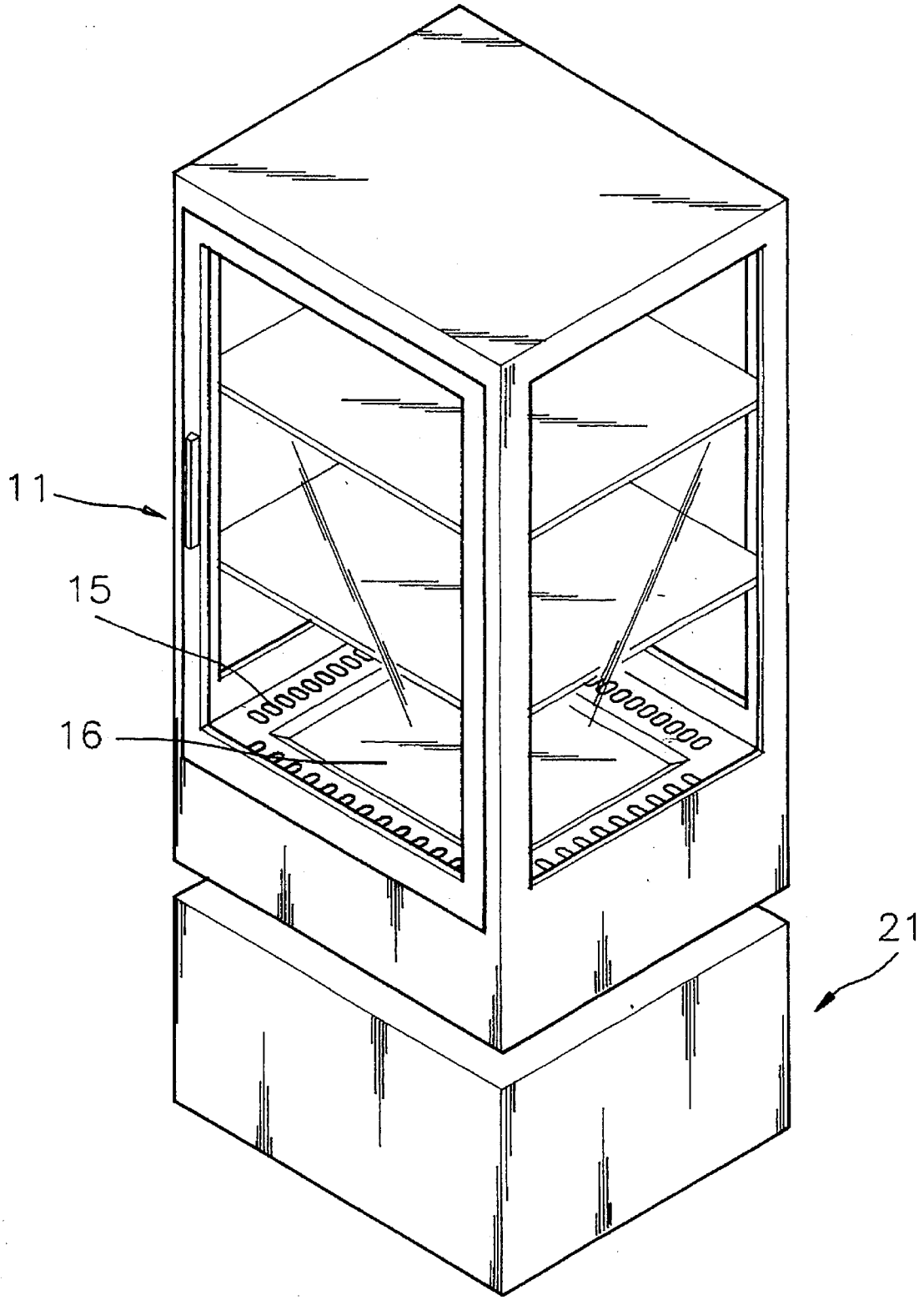
FIG. 6 sets forth a schematic perspective view of a low-temperature showcase in accordance with another preferred embodiment of the present invention.

As shown in FIG. 6, the side walls 30 of the upper case 11 may be made of a transparent material. Alternatively, the upper case may have transparent side doors instead of the side walls.

In such a low-temperature showcase, since the upper case 11 has the front and the rear doors 12, 12' and is rotatable, it is easier to take out the foods placed at the far side from the front door 12, or near the rear door 12'.

Although the invention has been shown and described with respect to the preferred embodiments, it Will be understood by those skilled in the art that various changes and modifications may be made without departing from the spirit and scope of the invention as defined in the following claims.

What is claimed is:

1. A low-temperature showcase comprising:

an upper case including at least two doors, an intermediate plate provided with a plurality of air passages formed along edges thereof, a bottom plate having an opening and an air duct defined by the intermediate plate and the bottom plate;

a lower case including a cavity in which an evaporator and a fan are installed, the evaporator and the fan for generating a cold air flow which is circulated along the air duct and into an interior of the upper case; and means for rotatably supporting the upper case, the supporting means being interposed between the upper and the lower cases.

2. The low-temperature showcase of claim 1, wherein the supporting means includes a ring-shaped upper member provided with an annular groove, a ring-shaped lower member provided with a plurality of recesses formed along a circular shape corresponding to the annular groove and a plurality of balls fitted into both the recesses and the groove, the upper and the lower members being fixed to an under surface of the bottom plate of the upper case around the opening and a top surface of the lower case around the cavity, respectively, the balls for bearing the upper members, thereby allowing the upper member and the upper case to be rotatable.

3. The low-temperature showcase of claim 2, wherein the upper member of the supporting means is provided with a cut-out portion provided along a circumferential surface thereof, and the supporting means further includes a plurality of restrainers whose the ends are secured to a circumferential surface of the lower member and the other ends are fitted into the cut-out portion of the upper member, thereby preventing the upper member from deviating from the lower member.

4. The low-temperature showcase of claim 1, wherein side walls of the upper case are made of a transparent material.

* * * * *